United States Patent [19]

Filip

[11] Patent Number: 4,813,405

[45] Date of Patent: Mar. 21, 1989

[54] DEVICE FOR STIMULATING FEET HAVING RIGID SPHEROIDS IN DAMPENING MEDIUM

[76] Inventor: Stanislaw Filip, 2007 Bloor Street West, Apt. 201, Toronto, Ontario, Canada, M6S 1M5

[21] Appl. No.: 100,473

[22] Filed: Sep. 24, 1987

[51] Int. Cl.[4] ..... A61H 7/00

[52] U.S. Cl. ..... 128/60; 128/61

[58] Field of Search ..... 128/59, 60, 61

[56] References Cited

U.S. PATENT DOCUMENTS

| | | | |
|---|---|---|---|
| 793,527 | 6/1905 | King | 128/60 |
| 2,079,311 | 5/1937 | Blumenthal | 128/60 |
| 2,777,440 | 1/1957 | Baker | 128/67 |
| 3,273,633 | 9/1966 | Seidman et al. | 181/127.1 |
| 3,459,179 | 8/1969 | Olesen | 128/60 |
| 3,886,939 | 6/1975 | Boxer | 128/60 |
| 4,076,876 | 2/1978 | Bowles | 128/60 |
| 4,509,510 | 4/1985 | Hook | 128/60 |

FOREIGN PATENT DOCUMENTS

| | | | |
|---|---|---|---|
| 17534 | of 1888 | United Kingdom | 128/60 |

*Primary Examiner*—Edgar S. Burr
*Assistant Examiner*—Tonya Lamb
*Attorney, Agent, or Firm*—Sim & McBurney

[57] ABSTRACT

A device for stimulating the soles of a person's feet comprises a plastic holder having a central recess. A multiplicity of spherical plastic bearings of different sizes are supported within the recess in a loosely-packed layer. A dampening medium such as a gel surrounds the bearings to dampen their movement. A plastic film overlays the bearings and conforms to the shape of the underlying bearings when stepped on by the feet. A user simply stands on the plastic film and rocks thereby displacing the bearings and stimulating various parts of the bottoms of his feet.

10 Claims, 1 Drawing Sheet

DEVICE FOR STIMULATING FEET HAVING RIGID SPHEROIDS IN DAMPENING MEDIUM

FIELD OF THE INVENTION

The invention relates to a device for stimulating the bottoms of a person's feet.

DESCRIPTION OF THE PRIOR ART

A person's feet are normally confined for large portions of each day in shoes and socks or hosiery. When shoes are removed, the feet are normally exposed to even floor surfaces such as wood, carpeting, cement or the like. People no longer tend to experience any significant measure of contact between the bare bottoms of their feet and irregular natural surfaces present by earth, grass and sand.

It is an accepted theory in some quarters that receptors in the bottoms of the feet communicate along nerve paths to various parts of the body. It is believed that, in a more natural environment, various organs, glands and nerves of the body are stimulated by the contact the feet make with natural surfaces, and that such contact may relax and revitalize the body. Such a theory is consistent with the teachings of oriental medicine, accupuncture and accupressure, and also with western teachings regarding zone and reflex therapy. According to such teachings and theories, stimulation of various parts of the feet can produce beneficial effects elsewhere, in localized parts in the body.

BRIEF SUMMARY OF THE INVENTION

In one aspect, the invention provides a device for stimulating a person's feet. The device comprises a holder having a recess in which are retained a multiplicity of spheroid members preferably in the form of a loosely-packed layer. A dampening material is preferably provided to dampen movement of the spheroid members. A cover overlays the spheroid members, the cover being formed of a material which conforms to the shape of the underlying spheroid members when stepped on by the feet.

In use, a person may step on the cover and rock repeatedly from his heels to the balls of his feet for a brief period of time, such as two minutes. No immediate effect may be noticed. However, in tests performed with a prototype device, it has been observed within about fifteen minutes of such use that a tingling sensation can be noticed in the feet and that the sensation has a tendency to travel upwardly towards the body. The duration of the effect cannot be readily predicted; however, it has been noted that the sensations produced by the device can have a duration of up to about twelve hours. Although the effect is not entirely understood, it appears consistent with the above-noted theory that receptors in the feet may in fact be linked to various body parts. The device permits an individual whose feet are otherwise confined in shoes and exposed only to level or soft surfaces to experience in a very brief period of time the type of stimulation which nature might otherwise provide through exposure of the feet to natural elements throughout the day.

Other aspects of the invention and advantages associated therewith will be more apparent from a description of a preferred embodiment below and are defined in the appended claims.

DESCRIPTION OF THE DRAWINGS

The invention will be better understood with reference to drawings illustrating a preferred embodiment in which.

DESCRIPTION OF THE PREFERRED EMBODIMENT

Figure 1:
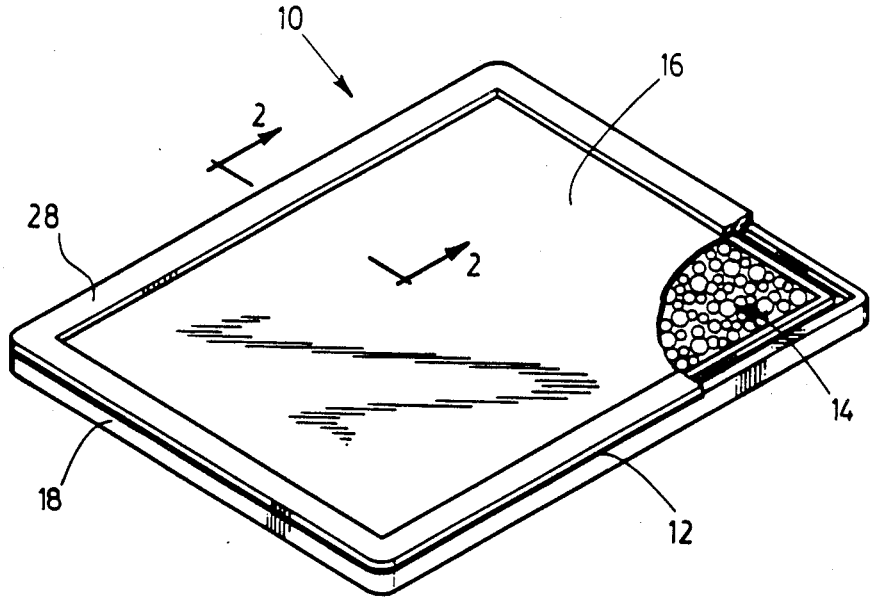
FIG. 1 is a perspective view of a foot stimulator with a plastic cover partially fragmented to reveal plastic bearings contained within the device.
Figure 2:
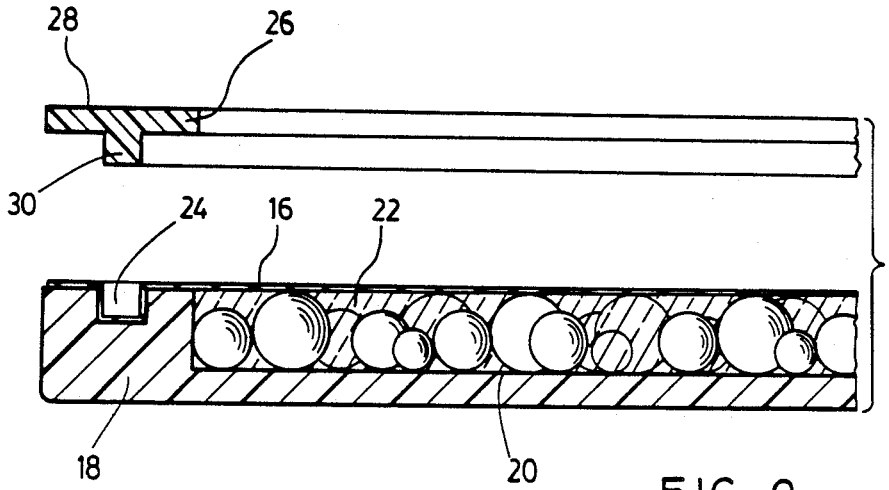
FIG. 2 is a fragmented cross-sectional view along the lines 2—2 of FIG. 1, partially exploded to illustrate how the plastic cover is retained.

Reference is made to FIGS. 1 and 2 which illustrate a foot stimulator 10 embodying the invention. The foot stimulator 10 comprises a plastic holder 12, a multiplicity of near-spherical plastic bearings generally indicated by the reference numeral 14, and a cover 16 formed of a 12 mil plastic film that overlays the bearings 14.

The plastic holder 12 has a generally rectangular shape and might have dimensions of about 12 inches by 18 inches. The holder 12 includes a rectangular base 18 formed with a central rectangular recess 20. The recess 20 is relatively shallow with a flat bottom such that the bearings 14 tend to form a single layer over the bottom. This layer is preferably loosely-packaged so that the bearings can be displaced relative to one another in response to pressure and movement of a user's feet against the cover 16. The bearings 14 are of a plurality of different sizes ranging from about $\frac{1}{4}$ to about $\frac{1}{2}$ inches in diameter.

The recess 20 is partially filled with a gel 22 which surrounds and engages the bearings 14 to dampen their movement. The dampening medium might be a viscous oil, but a gel or other semi-solid dampening material is preferred as there is less likelihood of leakage or spilling in the event that the cover 16 is torn. An alternative dampening medium includes a layer of cotton wool which can be placed at the bottom of the recess 20 with the bearings 14 overlying the cotton. Such measures would reduce the tendency of the bearings to displace in response to superjacent pressure.

The plastic film 16 serves two principal functions or aspects. First, it serves to retain the bearings 14 and the gel 22 when the foot stimulator 10 is transported. Second, when stepped on, the plastic film 16 tends to conform to the shape of the underlying bearings 14. Accordingly, the feet of a user standing on the film 16 tend to be exposed at different locations to the hard outer surfaces of the bearings 14.

The film 16 is attached to the holder 12 using a simple press fit. To that end, the base 18 has a circumferential groove 24 surrounding and spaced from the central recess 20. The holder 12 comprises a plastic retaining member 26 having a flat rectangular portion 28 which defines an upper surface of the holder 12 and having a circumferential downwardly-extending wall 30 with shape and dimensions complementary to those of the rectangular groove 24. The wall 30 simply press fits edge portions of the film 16 into the groove 24 thereby sealing the recess 20 and securing its contents.

Assembly of the foot stimulator 10 is relatively simple. The gel may be introduced into the recess 20. The bearings 14 may then be deposited into the gel 22. For a holder of the size described, in excess of 2000 bearings might typically be required. Accordingly, it is desirable that the bearings be formed of a material such as a plastic which is relatively light-weight. The rectangular sheet of plastic film 16 is then placed over the central recess 20 and the circumferential groove 24, and the retaining member 26 is then press fit into the groove 24 to secure the film 16. It will be apparent that the construction of the foot stimulator 10 is relatively simple and lends itself to easy assembly.

As mentioned above, a user simply stands on the cover 16 and rocks his feet or otherwise moves them relative to the underlying bearings 14. Since the film 16 yields to the bearings 14, the user's feet will be exposed to the shape of the underlying layer of bearings 14. It should be noted that the bearings 14 have been selected with different sizes to better approximate the stimulating effect of natural surfaces such as gravel or rough dirt which would have a large number of irregularly shaped components. The bearings 14 are preferably loosely-packed such that they tend to displace in response to movement of the feet to enhance the stimulation of different points on the soles of the feet. This arrangement also tends to ensure that the feet will be exposed to the smaller-sized bearings as the larger bearings are displaced. The gel 22 ensures that no sudden voids develop as the user steps and rocks over the film 16 and contributes to comfort in use by ensuring that the bearings are not suddenly displaced with each step. Additionally, during transportation of the foot stimulator 10, the gel 22 tends to reduce the rattling which might otherwise be expected.

It will be appreciated that a particular embodiment of the invention has been described for purposes of illustrating the principles inherent in the invention and should not be regarded as necessarily restricting the spirit of the invention or the scope of the appended claims. In particular, it is not essential to the invention as defined in the claims that the bearings or equivalent members have a spherical shape. Basically, it is desirable that their shape be smooth and roughly spheroid to ensure that sharp edges do not pierce the cover and cause discomfort to the feet. It is sufficient for purposes of the invention that such members be similar to spheroids in exposing rounded surfaces to the cover material and to the user's feet.

I claim:

1. A device for stimulating a person's feet, comprising:

a holder having a recess;

a multiplicity of rigid spheroid members supported in a loosely-packed layer within the recess;

a dampening medium located within the recess and engaged with the spheroid members to dampen movement of the spheroid members; and, a cover attached to the holder and overlaying the layer of spheroid members, the cover being formed of a material which conforms to the shape of the underlying spheroid members when stepped on by the feet.

2. A device as claimed in claim 1 in which the dampening medium is a gel surrounding the spheroid members.

3. A device as claimed in claim 1 in which the spheroid members have a plurality of different sizes.

4. A device as claimed in claim 1 in which the cover is a plastic film.

5. A device for stimulating a person's feet, comprising:

a holder having a recess;

a multiplicity of rigid spheroid members retained within the recess, the spheroid members being characterized by a plurality of predetermined different sizes;

a cover attached to the holder and overlaying the spheroid members, the cover being formed of a material which conforms to the shape of the underlying spheroid members when stepped on by the feet;

the spheroid members being loosely packed such that the spheroid members can be displaced in response to a user stepping on the cover to expose the user's feet simultaneously to spheroids of different sizes.

6. A device as claimed in claim 5 in which the spheroid members form a loosely-packed layer in the recess.

7. A device as claimed in claim 6 in which the device comprising a dampening medium located within the recess for dampening movement of the spheroid members.

8. A device as claimed in claim 7 in which the dampening medium is a gel surrounding the spheroid members.

9. A device as claimed in claim 5 in which the cover is a plastic film.

10. A device as claimed in claim 9 in which:

the holder comprises a circumferential groove surrounding the recess; and the holder comprises at least one retaining member which presses the film into the circumferential groove.

* * * * *